US006871779B1

(12) United States Patent
Whitney, Jr.

(10) Patent No.: US 6,871,779 B1
(45) Date of Patent: Mar. 29, 2005

(54) MAILBOX

(76) Inventor: Leonard Frank Whitney, Jr., 57 Jamestown St., Gowanda, NY (US) 14070

( * ) Notice: Subject to any disclaimer, the term of this patent is extended or adjusted under 35 U.S.C. 154(b) by 0 days.

(21) Appl. No.: 10/293,567

(22) Filed: Nov. 13, 2002

(51) Int. Cl.[7] ..... B65G 11/04
(52) U.S. Cl. ..... 232/45; 232/17
(58) Field of Search ..... 232/45, 17, 44

(56) References Cited

U.S. PATENT DOCUMENTS

| | | | | | |
|---|---|---|---|---|---|
| 706,843 | A | | 12/1902 | Moore | |
| 3,498,256 | A | * | 3/1970 | Hebal | 232/35 |
| 4,026,461 | A | * | 5/1977 | Hodge | 232/17 |
| 4,413,770 | A | * | 11/1983 | Nye | 232/17 |
| 4,660,757 | A | | 4/1987 | Hicks | |
| 4,723,702 | A | | 2/1988 | Martin | |
| 4,863,096 | A | | 9/1989 | Thomas | |
| 4,930,271 | A | * | 6/1990 | Pizzichemi | 52/155 |
| 5,031,828 | A | * | 7/1991 | Fischer | 232/39 |
| 5,178,320 | A | * | 1/1993 | Bertone | 232/17 |
| 5,617,993 | A | * | 4/1997 | Morris | 232/27 |
| 5,833,132 | A | * | 11/1998 | Bachmeier | 232/47 |
| 6,299,061 | B1 | * | 10/2001 | Henson | 232/47 |

FOREIGN PATENT DOCUMENTS

| | | |
|---|---|---|
| GB | 2225645 | 1/1992 |

* cited by examiner

*Primary Examiner*—William L. Miller
(74) *Attorney, Agent, or Firm*—Vincent G. LoTempio

(57) ABSTRACT

A mailbox, particularly useful for rural mail delivery, comprises a housing having an inwardly opening access door for the depositing and withdrawal of mail, newspapers, and the like. The front wall of the housing comprises a bottom portion, two side edges, and an upper edge defining an opening through which mail and the like may be inserted and withdrawn. The top of the access door is hingedly connected to the housing at the upper part of the opening so that when closed the door covers the opening. When mail is inserted, the door is pushed upwardly and inwardly after which the door swings back to the closed position automatically under the force of gravity. The return swing to the closed position is aided by a weight attached to the inside of the door. The access door has a magnetic closure. The deposited mail rests on an open mesh panel having passages for water drainage. The mesh panel is positioned low enough to allow an accumulation of mail without interfering with the swing of the door.

5 Claims, 4 Drawing Sheets

MAILBOX

BACKGROUND OF THE INVENTION

1. Field of the Invention

This invention relates generally to receptacles for mail, newspapers and the like, specifically to a mail collection box for rural and city delivery.

2. Brief Description of the Prior Art

Conventionally, a mailbox erected at the edge of a roadway or curbside of a street in a rural area, town and village is positioned so as to allow a postal carrier to drive up to the mailbox. Street side mailboxes serve two important and primary purposes, the first of which is to receive mail and other deliveries, to include newspapers, magazines, and like, and the second of which is to provide a deposit point for outgoing mail and parcels for pick up by the letter carrier as he or she makes their rounds. Roadside located mailboxes are typically provided with a hinged door that opens outward from the bottom of the mailbox. This positioning results in the opening of the mail box being directed outwardly toward the roadway with the open end of the mail box protruding over the edge of the roadway, or closely thereto, such that the mail carrier can insert the mail into the mailbox without leaving his or her vehicle. When the door to the mailbox is opened it typically hits and scratches the mail truck or car. Also in order to gain access to the interior compartment of the mailbox the door has to be manually opened and closed by the mail person. The manual opening and closing of a mailbox door and lowering of a mailbox flag by a mail carrier is a time-consuming task. The problem is greatly amplified when repeated many times along the course of a mail route. In addition, mailboxes typically have flat solid continuous floors without drainage. When water enters the interior compartment of a mailbox it typically damages any object contained therein. Mailboxes are known in the art. Accordingly, a need exists for a mailbox that allows for safe and easy access that overcomes the above drawbacks.

Many prior attempts have been made to mitigate the problems associated with rural mail delivery. For example:

U.S. Pat. No. 706,843 to Moore discloses a mailbox having a hinged door within the doorframe with a lock. The door is provided with a slot that is guarded by a swinging shutter or flap, the ends of which are pivoted or hinged to the door. When the flap is moved it triggers the flag to indicate mail has been deposited. The slot limits the size and quantity of mail that can be deposited into the mailbox at one time. Additionally, this mailbox is provided with a locking hinged door, which swings open from the side. The locked door cannot be opened by a mail carrier to deposit larger mail items.

U.S. Pat. No. 4,660,757 to Hicks discloses a dual access newspaper box with a door that opens inwardly and is hinged from the top for easy insertion of a newspaper. This device is a receptacle for newspapers with a frontal end and a back end for receiving and holding newspaper materials for storage and withdrawal of such materials from the receptacle. The door is attached to a rod and the door pivots and swings into the housing area. The rod is inserted in an opening for free rotation and a coil spring is affixed to the wall to serve to bias the door from completely free movement when it is moved inwardly. This receptacle however, is of no use in receiving deposited articles that are of a length greater than that the open area within the housing because the article must be placed clear of the door so that the door may close properly. In addition this device is not provided with a mechanism to alert the carrier that there are items left in the box that need to be picked up.

U.S. Pat. No. 4,723,702 to Martin discloses another newspaper box, again with an inwardly opening door for easy insertion of the newspaper. However the newspaper has to be pushed deep into the compartment of the box so as to allow the door to be closed. Here too, there is no way to present mail or the like to be picked up by the delivery person.

U.S. Pat. No. 4,863,096 to Thomas shows a mailbox insert that is placed inside a collection mailbox, and is placed at the bottom of the box to protect the contents from any liquid that might accumulate at the bottom, to protect the mail. This mailbox insert is comprised of a plate that is composed of substantially ridged material such as sheet metal. The plate metal is corrugated in a configuration as a series of alternating ridges and valleys.

Great Britain Patent No. 2,225,645 to Alpha Industries Ltd shows a mailbox with a flap swinging into the box. The flap is operatively arranged to simultaneously move an interior door that provides a barrier between the mail that has been previously deposited and the opening for the flap. Although this device may provide for security against theft, the opening is situated so as to limit the size and quantity of mail that can be deposited at one time. Additionally outgoing mail cannot be placed in an accessible location within the device.

The present invention seeks to alleviate the problems previously associated with mailboxes.

SUMMARY OF THE INVENTION

It is an object of the present invention to provide an efficient mailbox or parcel receptacle.

It is a further object to provide such a mailbox or parcel receptacle that can accept mail safely by simply pushing the mail into the mailbox through an inwardly swinging door.

It is still a further object to provide a mailbox or parcel receptacle with a self-closing magnetic door.

It is another object of the invention to provide a mailbox or parcel receptacle with a floor that remains dry.

It is still another object to provide a mailbox or parcel receptacle that eliminates the need for a flag by including a site for outgoing letters to be conveniently presented to the postal carrier.

Another object of the invention is to provide a mailbox with an inwardly swinging door that can freely swing closed after mail is deposited into the internal compartment.

The above and other objects are accomplished in accordance with the present invention which comprises a device for collecting mail, newspapers and the like comprising a housing having a front wall, two side walls, a rear wall, a top panel, and a floor panel. The front wall having a bottom portion, two side edges, and an upper edge defining an opening through which mail and the like is inserted and withdrawn. The device includes an inwardly opening access door that is hingedly connected to the housing at an upper region of the opening. The mailbox additionally comprises a resting surface above the floor panel and co-extensive therewith and having open passages for water drainage. The resting surface being positioned at a level below the door panel to allow deposited mail to rest thereon without interfering with free movement of the access door.

The device of the present invention and its use may be readily understood with reference to its use as a mailbox located on a roadside, wherein an article, such as a letter or a newspaper, is placed in the housing of the mailbox by a delivery person from a vehicle. Mailboxes are typically equipped with an outwardly swinging door that is hinged from the bottom of the box. This configuration requires the delivery person to perform the time consuming task of opening and closing the door. In the mailbox of the present invention, the opening of the delivery process step is accomplished by pushing mail through the inwardly swinging door and the closing step is eliminated since the door of the present mailbox swings closed automatically after an object is placed inside. In addition the resting surface of the mailbox is situated sufficiently below the door so as to allow mail to rest anywhere in the interior compartment without hindering the door from returning to a closed position.

In a preferred embodiment the mailbox of the present invention is configured with an extension along the front wall, suitable for placing letters between the door and the front wall so that the delivery person can easily observe and pick up outgoing mail. This feature eliminates the need for a flag to notify the delivery person of outgoing mail within the mailbox.

BRIEF DESCRIPTION OF THE DRAWINGS

The present invention and the manner in which it may be practiced is further illustrated with reference to the accompanying drawings wherein.

DETAILED DESCRIPTION OF THE INVENTION

Figure 1:
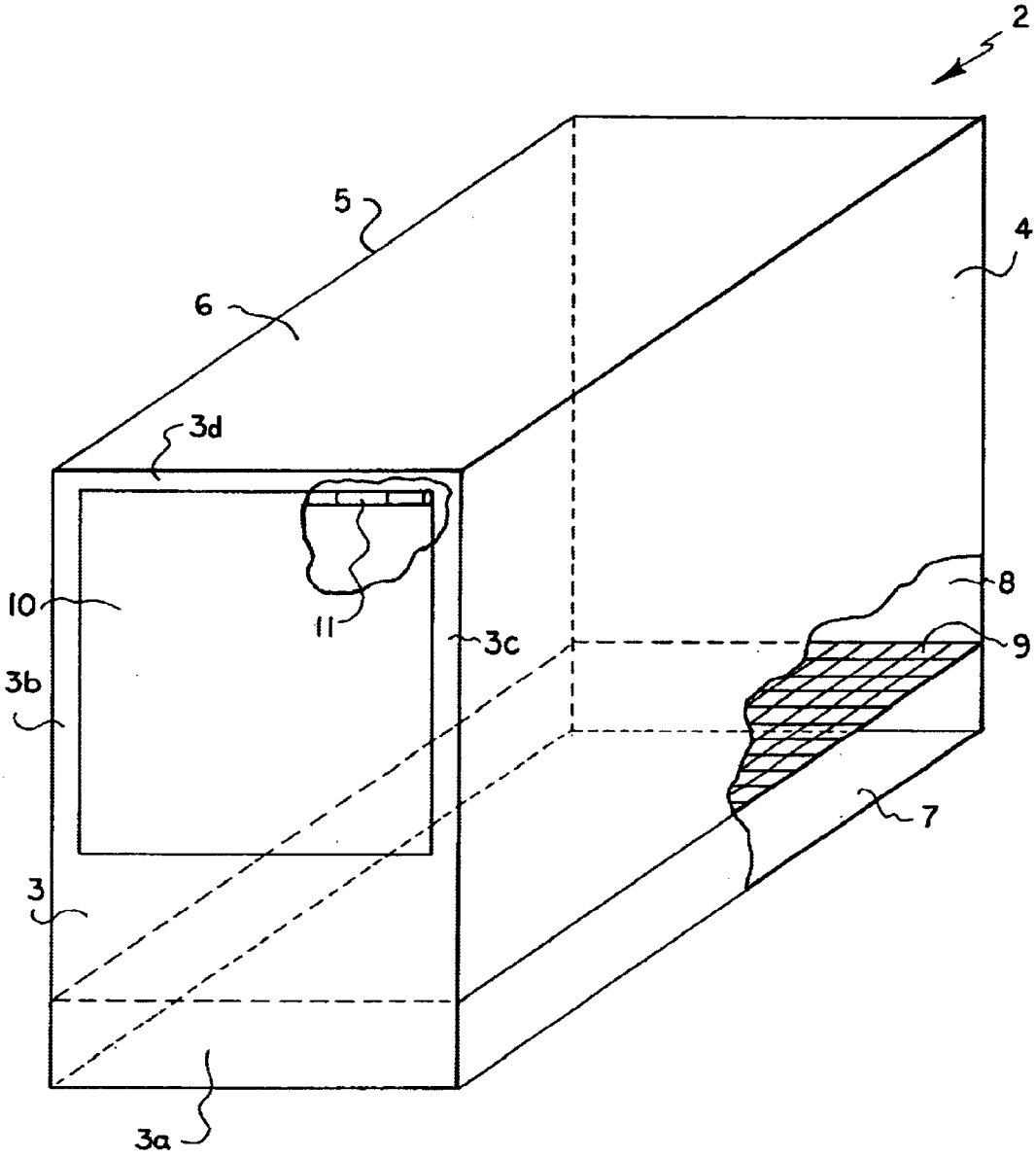
FIG. 1 is a perspective view of a mailbox in accordance with the present invention shown in partial cut-away.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

With reference to FIG. 1, mailbox 2 of the present invention includes front wall 3, having a bottom portion 3*a*, side edges 3*b* and 3*c* and upper edge 3*d*; rear wall 8; opposing side walls 4 and 5; top panel 6; floor panel 7. Spaced above floor panel 7 and co-extensive therewith is mesh panel 9. The segments of front wall 3, that is the bottom portion 3*a*, side edges 3*b* and 3*c* and upper edge 3*d*, surround an opening covered on the inward side by inwardly opening door 10, held by hinge 11 to the upper part of the housing. Various types of hinges can be used in the preferred embodiment of the present invention, for example a piano hinge or cylindrical rod, and the like.

Although the dimensions of mailbox 2 may vary considerably, the height will typically be about 11 inches, with the bottom portion 3*a* of front wall 3 being about 4 inches in height, to permit easy access when door 10 is pushed inwardly for depositing or retrieving of mail or the like. Bottom portion 3*a* of front wall 3 substantially defines the area available bellow the door for deposited articles to rest without interfering with the free movement of the door. The door is of a sufficient size and dimension to overlap the opening when in the closed position. It should be appreciated that the dimensions of the front wall, the door and the housing in general can vary to accommodate different sized articles of deposit. Furthermore, although the overall shape of the housing may vary somewhat, it will typically be a rectangular box shape.

When mail, newspapers, or the like is deposited, it will come to rest on mesh panel 9, which is a resting surface or support panel that is made of an open mesh material that will allow liquids, especially water that might enter when door 10 is opened, for example, during rainy weather, to pass through to floor panel 7. The mail or other deposited material will then rest on the dry resting surface of mesh panel 9. Alternatively, mesh panel 9 can be replaced with a corrugated sheet having pointed peaks and valleys arranged so that the pointed peaks comprise a resting surface. The valleys of the corrugated sheet serve as passages for water drainage. Optionally, floor panel 7 may be provided with one or more holes (not shown) to allow water to exit the mailbox. The mailbox may be fabricated from various materials including, for example, metal, plastic or other suitable material. A preferred material is galvanized steel.

Figure 2:
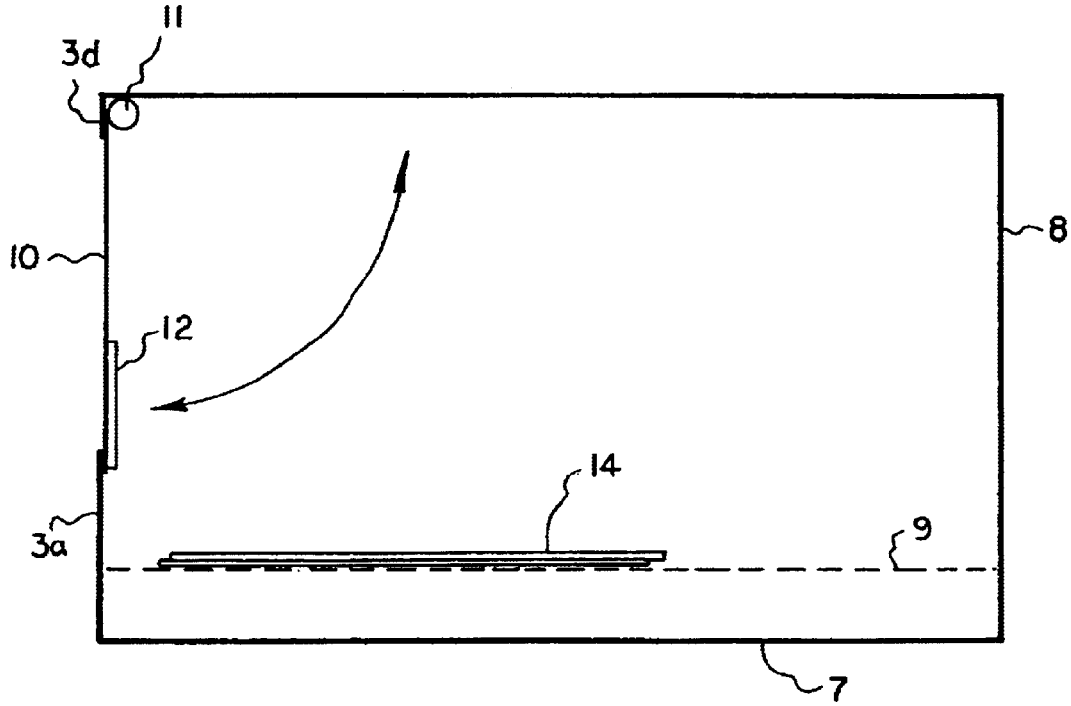
FIG. 2 is a side cross-sectional view of an embodiment of the mailbox of the invention.

FIG. 2 is a side cross-sectional view, showing a preferred embodiment wherein access door 10 is provided with an attached weight 12 to assist in the closure thereof. In a still further preferred embodiment weight 12 may be a magnet. In this embodiment, the bottom portion 3*a* of front wall 3 is made of a magnetic material such as galvanized steel.

Alternatively, if the mailbox is constructed of a non-magnetic material, such as plastic, a covering of magnetic material may be secured to the inside of the bottom portion 3*a*, positioned to magnetically interact with the magnet secured to access door 10 to hold the door closed when not in use (not shown in figures). The arrows in FIG. 2 show the direction of movement of access door 10 during opening and closing.

Figure 3:
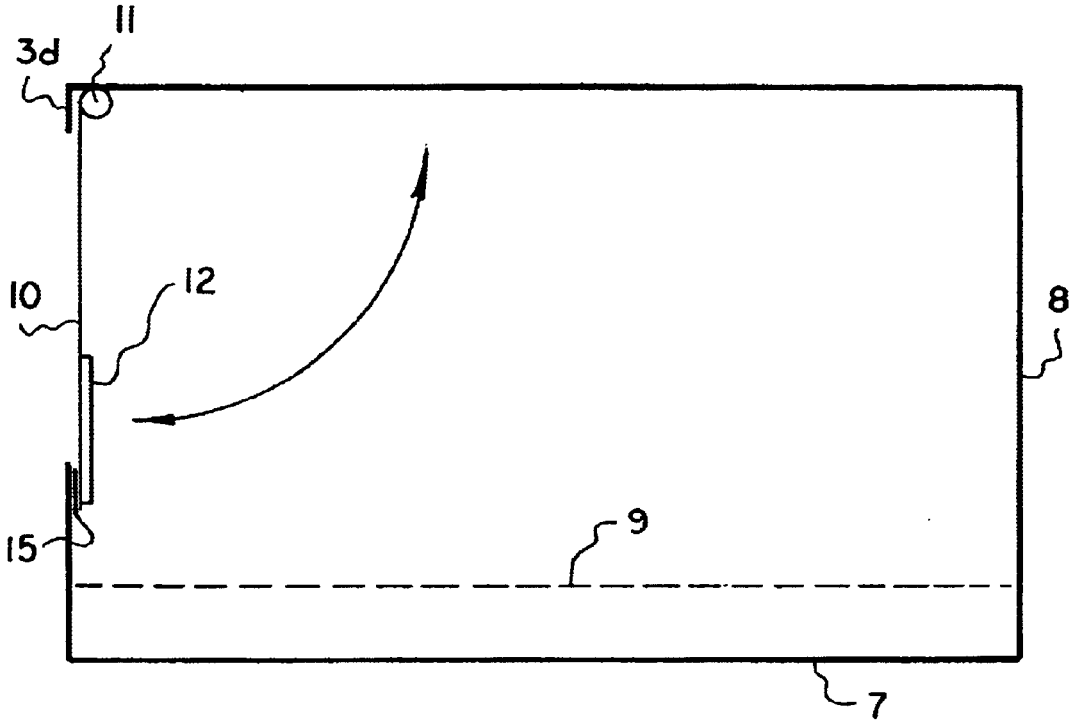
FIG. 3 is a side cross-sectional view of the front portion of the mailbox incorporating a magnetic closure for the door.

In another embodiment of the invention, as shown in FIG. 3 when the mailbox is in a closed mode, the door 10 may be lightly secured to the front wall 3 by a magnetic closure. This may be accomplished, as shown in FIG. 3, by providing magnet 15, preferably in the form of a magnetic strip, along the interior side of front wall 3 at the upper part of bottom portion 3*a*, to magnetically interact with the lower portion of access door 10. In this embodiment, when the door swings downward and closes against the interior of bottom portion 3*a*, it will be secured by magnetic attraction. In either embodiment, the magnet may be selected having sufficient magnetic strength so that the closed door may be easily pushed open by hand and yet resist being opened by the force of a moderate wind.

Figure 4:
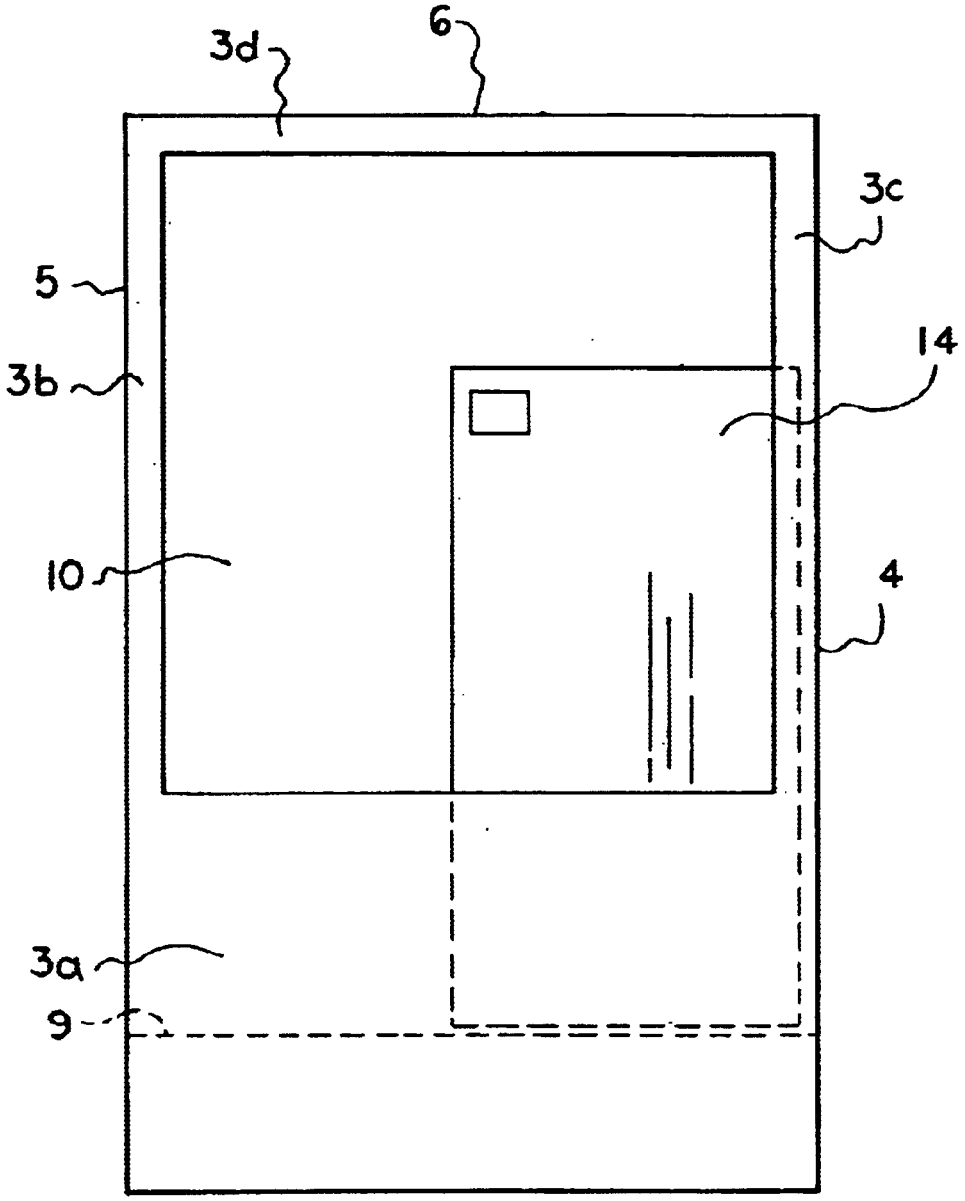
FIG. 4 is a front view of the mailbox in partial cut-away to illustrate a use thereof.

FIG. 4 is a front view illustrating an advantageous use of the mailbox of this invention, in holding mail to be picked up by a mail carrier. An article to be picked up, letter 14 for example, may be placed between door 10 and front wall 3 as shown, with the lower portion of letter 14 resting on mesh panel 9 and the letter nestled between bottom portion 3*a*, side edge 3*c* (or 3*b*, not shown) and the access door. Typically, letter 14 is a standard sized letter, for example a business letter of about 9½×4 inches or, a personal letter of 3½×6½ inches. Mesh panel 9 is spaced at a distance from the end of the door so as to both allow for sufficient space to place an outgoing letter in a visible position and to provide space for at least 12 standard letters to be deposited directly below the door without hindering the free movement of the door.

Although the invention has been described with reference to certain embodiments thereof, it will be appreciated by those skilled in the art that modifications and variations may be made without departing from the spirit and scope of the invention except as defined in the appended claims. It is intended that all matter contained in the above description or shown in the accompanying drawings, shall be interpreted as illustrative and not in a limiting sense.

It is also to be understood that the following claims are intended to cover all the generic and specific features of the invention herein described, and all statements of the scope of the invention that, as a matter of language, might be said to fall therebetween.

What is claimed is:

1. A mailbox comprising:

a housing having a front wall, two side walls, a rear wall, a top panel, and a floor panel; said front wall having a bottom portion, two side edges, and an upper edge defining an opening through which mail may be inserted and withdrawn;

an inwardly opening access door hingedly connected to said housing at an upper region of said opening wherein said access door has a magnetic closure;

a resting surface, wherein said resting surface is an open mesh panel, above said floor panel and co-extensive therewith and having open passages for water drainage;

said resting surface being positioned at a level below said access door to allow deposited mail to rest thereon without interfering with free movement of said access door wherein a weight is attached to said access door.

2. A mailbox according to claim 1 wherein said weight is a magnet.

3. A mailbox according to claim 1 wherein an inside upper part of said front wall includes a magnet.

4. A mailbox comprising:

a housing having a front wall, two side walls, a rear wall, a top panel, and a floor panel; said front wall having a bottom portion, two side edges, and an upper edge defining an opening through which mail may be inserted and withdrawn;

an inwardly opening access door hingedly connected to said housing at an upper region above said opening to allow said door to swing inwardly and upwardly when opened; said access door having an attached weight to aid in a return downward swing to a magnetic closure; said door being appropriately dimensioned to rest behind said opening overlapping said bottom portion, said side edges, and said upper edge;

an open mesh support panel above said floor panel and co-extensive therewith and having open passages for water drainage; said support panel being positioned at a level below said access door, when closed, to allow deposited mail to rest thereon without interfering with free movement of said access door.

5. A mailbox according to claim 4 wherein said support panel is positioned at a suitable level below said access door, when closed, to allow a standard sized envelope, vertically oriented, to rest thereon with the upper portion of an envelope being visible from the outside of said mailbox and being held in place between said access door and said bottom portion and between said access door and at least one said side edges.

* * * * *